US005661395A

United States Patent [19]

Johnson et al.

[11] Patent Number: 5,661,395

[45] Date of Patent: Aug. 26, 1997

[54] ACTIVE, LOW VSD, FIELD EFFECT TRANSISTOR CURRENT SOURCE

[75] Inventors: David K. Johnson, Plano, Tex.; Daniel Edward Skooglund, Fishkill; Michael Anthony Sorna, Poughkeepsie, both of N.Y.

[73] Assignee: International Business Machines Corporation, Armonk, N.Y.

[21] Appl. No.: 534,900

[22] Filed: Sep. 28, 1995

[51] Int. Cl.[6] ..... G05F 3/20

[52] U.S. Cl. ..... 323/273; 323/312; 323/316

[58] Field of Search ..... 323/311, 273, 323/312, 313, 314, 315, 316; 330/288; 327/530, 538

[56] References Cited

U.S. PATENT DOCUMENTS

| | | | |
|---|---|---|---|
| 4,091,432 | 5/1978 | Muller | 361/56 |
| 4,270,081 | 5/1981 | Hareyama | 323/316 |
| 4,292,584 | 9/1981 | Kusakabe | 323/316 |
| 4,381,484 | 4/1983 | Jarrett | 323/316 |
| 4,399,399 | 8/1983 | Joseph | 323/315 |
| 4,498,041 | 2/1985 | Kuwahara | 323/316 |
| 4,645,948 | 2/1987 | Morris et al. | 307/296 R |
| 4,651,083 | 3/1987 | Lachmann et al. | 323/316 |
| 4,714,872 | 12/1987 | Traa | 323/314 |
| 4,857,864 | 8/1989 | Tanaka et al. | 330/288 |
| 4,965,510 | 10/1990 | Kriedt et al. | 323/315 |
| 4,994,730 | 2/1991 | Rossi et al. | 323/316 |
| 5,180,966 | 1/1993 | Sugawara et al. | 323/308 |

*Primary Examiner*—Adolf Berhane
*Attorney, Agent, or Firm*—H. Daniel Schnurmann

[57] ABSTRACT

A current source circuit that operates advantageously in the linear region of an FET and that minimizes any voltage drop at its output node which is not load related. The circuit operates under the principle that the output current is dynamically measured without introducing any elements that affects the voltage drop across the FET. Its current source includes a pass device with feedback control, such that a constant current is obtained regardless of the load placed at the output terminal. The operation of the pass device is mirrored by a second pass device having physical dimension that only a fraction of those of the first pass device. A high input impedance differential amplifier, driven by the respective outputs of the first and second pass devices, forces the mirror pass device to the identical voltage as the first pass device.

20 Claims, 3 Drawing Sheets

FIG. 1 pFET I–V Characteristics
(PRIOR ART)

FIG. 2 (PRIOR ART) Current Measurement in Series with Output

ACTIVE, LOW VSD, FIELD EFFECT TRANSISTOR CURRENT SOURCE

FIELD OF THE INVENTION

This invention relates, generally, to integrated current sources, and more particularly, to an active, low Vsd, FET acting as a current source.

BACKGROUND OF THE INVENTION

Active devices such as transistors have been routinely used by circuit designers as current sources. From circuit theory, it is known that a current source provides constant current independent of the voltage applied across the device. Both bipolar and FET field effect transistors have been used as current sources with equal success.

A typical integrated circuit current source has been described by Lachmann et al. in the U.S. Pat. No. 4,651,083, wherein a constant current output is obtained by having an operational amplifier with an inverting input to which a reference voltage is attached; a first stage to which the output is coupled to and by which the output voltage of the operational amplifier is converted into a first current; and a second stage coupled to the output of the operational amplifier for converting the output voltage of the operational amplifier to a second current, providing an output current which is essentially constant to a first approximation, and additional stages provided with a current mirror for outputting constant current over a wide region of voltages. Whereas Lachmann describes a circuit having feedback, it is limited to only bipolar devices, and cannot be implemented with FET devices.

Whereas the characteristics of an ideal current source can be achieved with standard transistors, several practical problems are known to introduce severe limitations that seriously affect the performance of the FET and, consequently, of the current source. Two of the main reasons of these limitations are: the voltage operating range and the output resistance of the FET current source.

Some of the limitations imposed by the aforementioned problems were found during the design of an IEEE 1394 Phy Chip which requires several current sources. This chip, well known to practitioners of the art, is a serial implementation of a parallel SCSI (Small Computer System Interface, i.e., a standardized peripheral interconnection scheme) I/O bus. IEEE Standard 1394 specifies interface levels for a 5 volt power supply, (wherein an interface includes drivers, receivers, low level protocols, and the like). A 1394 chip typically uses current mode signalling such that the current sources generate fixed currents that are driven across terminators to create appropriate voltage levels. The direction of the current through the terminators switches back and forth to create equal and opposite differential terminator voltages used for a first mode of signalling. Additionally, the terminals are connected to a variable voltage supply that switches between two levels to vary the signals common mode voltage. This common mode voltage is used as a second signalling mode.

It is common practice for many chip implementations to use a 3.3 volt CMOS technology of any circuit or chip, of which the Phy chip is one example, to reduce power consumption. The use of 3.3 volt technology to generate interface levels for a 5 volt interface creates a need for a current source that operates having a low voltage drop across it. The reduced voltage overhead (i.e., 3.3 volts when compared to the 5 volts) along with P1394 specification tolerances forces the current source to operate with as little as 50 millivolts across it. While investigating one such current source, the required operating Vsd across the current source FET was found to be so small, such that the resulting FET would have been prohibitive in its required size. Thus, using prior current sources, the design of the entire Phy Chip would have been unfeasible.

To gain a better understanding of the problem caused by the limitations, reference is made to FIG. 1 showing typical I–V characteristics of a typical FET, in this case a pFET, wherein the Source to Drain Current Isd is plotted against the Source to Drain Voltage Vsd. For optimum performance the transistor is to remain in the saturation region, i.e., to the right of the parabola defined by Vsd=Vsg–Vt. The FET acts as a current source in the "flat" section of the output characteristics, wherein Isd remains essentially constant over large variations of Vsd. Practitioners of the art will fully appreciate that below saturation, a current source loses its effectiveness. While the current Isd remains flat in the saturation region, in the linear region to the left of the parabola, the FET acts as a resistor so that highly non-linear voltage variations distort the operation of the FET as a current source. Moreover, at higher current levels, the linear region is even larger, thereby limiting the operating region of the current source even further.

The severe voltage range limitation of an FET operating in its linear region will be better understood in terms of the following discussion.

Normally, a current source, particularly, one implemented with FET devices, is designed based on two criteria: the current Ids and the minimum Vsd voltage level. Assuming a preferred minimum Vsd=110 mv and a current level I=4 mA, the width W to length 1 ratio of the device can be computed as follows:

$$S=2*I/(k'*Vsd+Vsd)=W/1,$$

wherein S=CMOS ratio (which is commonly obtained from any CMOS Design Manual), W=device width in μm, and L=device length in μm. By way of example:

$$S=2*4{,}000/(24*0.1*0.1)=33{,}333.$$

Additionally, to eliminate short channel modulation phenomena (represented by the slope of the curve of the current in the saturation region, when plotting the characteristic curves of an FET device), which detracts from the independence of Isd vs. Vsd, the transistor length become relatively large. Simulation runs indicate that a channel length of 4 μm. for a typical CMOS device provides adequate control of the channel modulation term (i.e., a modifier to the drain current of an FET device, which is a function of the physical parameters of the device). The resultant width W is:

$$W=S*L=3333*4\ \mu m=133{,}333\ \mu m.$$

Such a large FET is clearly unacceptable. From the aforementioned discussion, it is evident that the width becomes prohibitive due to the area consumed by the device, in addition to introducing unacceptable diffusion and gate capacitances.

FIG. 2 is a schematic diagram showing how to perform a prior art current measurement in series with the output of an FET. As previously stated, it is advantageous to operate the FET device in its linear region while still being able to maintain a constant current at the output node even in the presence of large variations of Vsd, since the current source can be made to operate using a small Vsd. The diagram shows a compensating setup that allows the FET to generate a constant current at its output, independent of the output node voltage or any load attached to it. Thus, conceptually, by placing an ammeter in series with the output node, a control setup could be configured to detect the amount of current flowing in or out of the output node and somehow restore it to its original current value. A negative feedback control setup can thus be used to achieve this goal.

Although the conceptual representation of the such a setup is theoretically simple and straight forward, its actual implementation is far from trivial. The main drawback resides in the manner of measuring current which usually produces a significant voltage drop across the measuring element. By way of example, a typical ammeter utilizes precision resistors, across which a voltage is measured. The additional resistor in series with the FET device further reduces the available voltage Vsd by a finite amount, essentially limiting the voltage from use where it is most needed, namely, across the load. Thus, an improved method for dynamically measuring the output current without inserting in series any component capable of affecting the output voltage is needed.

OBJECTS OF THE INVENTION

Accordingly, it is a primary object of the present invention to provide an integrated circuit constant-current source of the foregoing general type, such that the circuit overcomes the voltage limitations of an FET device.

It is another object of the invention to utilize feedback in conjunction with control gate voltage techniques to maintain the output current of the current source constant.

It is still another object of the invention to provide a constant current source with means to overcome the limitations introduced by the voltage operating range.

It is a further object of the invention to provide a constant current source capable of overcoming limitations introduced by the output resistance of the FET device.

SUMMARY OF THE INVENTION

With the foregoing and other objects in view, there is thus provided, in accordance with the present invention an integrated constant current source delivering constant current and operating in the linear and the saturation regions of a transistor device, comprising: a first active pass means for generating an output current; a means for measuring the output current; a second active pass means integral to and responsive to the measuring means, whereby the second active pass means mirrors the output current; and controlling means for keeping the output current constant in response to the measuring means, whereby the output current is held constant.

BRIEF DESCRIPTION OF THE DRAWINGS

The construction and the method of operation of the invention together with additional objects and advantages thereof will be best understood from the following description of specific embodiments when read in conjunction with the accompanying drawings, in which.

DETAILED DESCRIPTION OF THE PREFERRED EMBODIMENT

Figure 1:
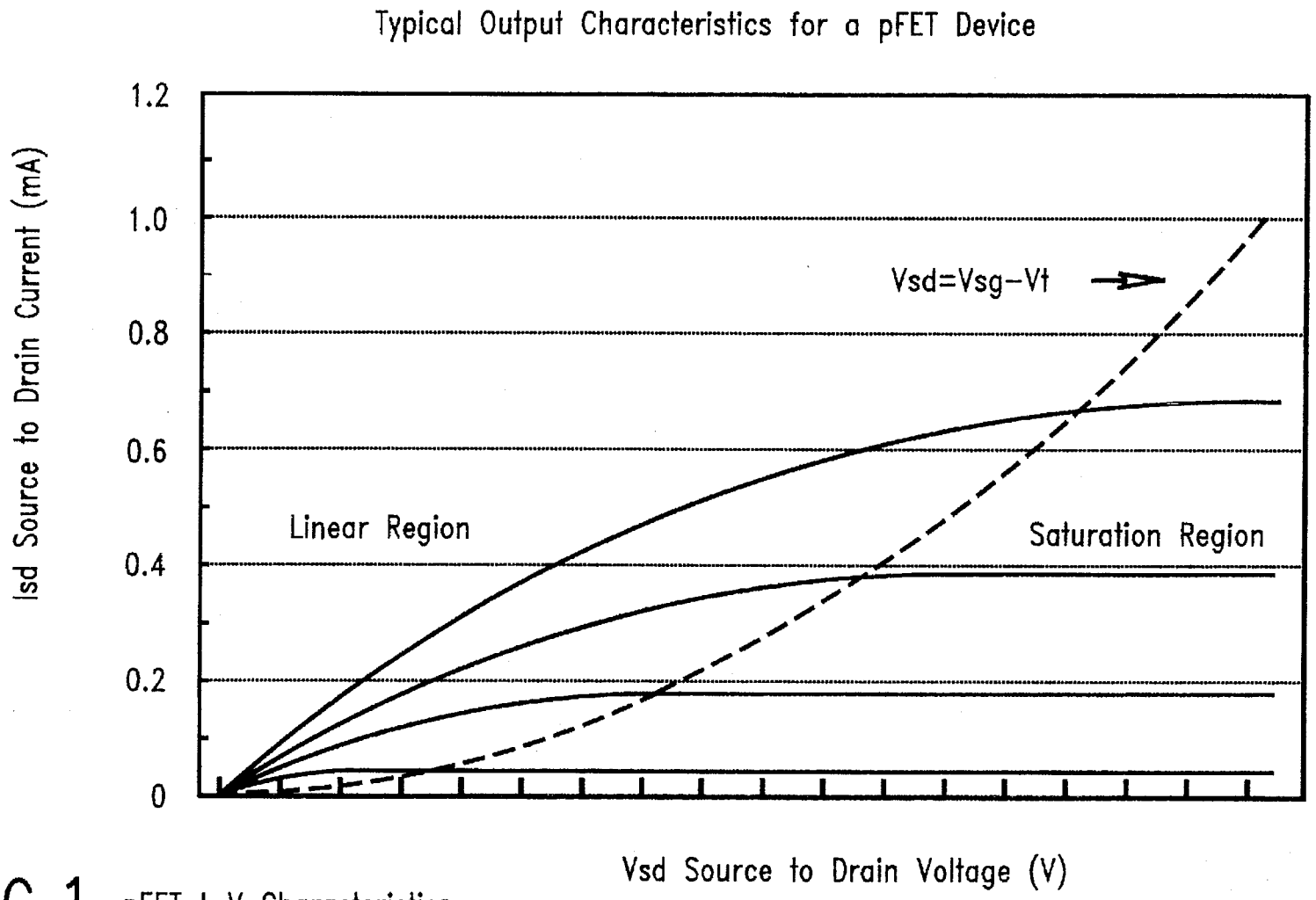
FIG. 1, as aforedescribed, is a plot diagram of typical Ids-Vsd characteristics of a pFET device. These I–V curves represent pFETs used in both prior art and in the invention.
Figure 2:
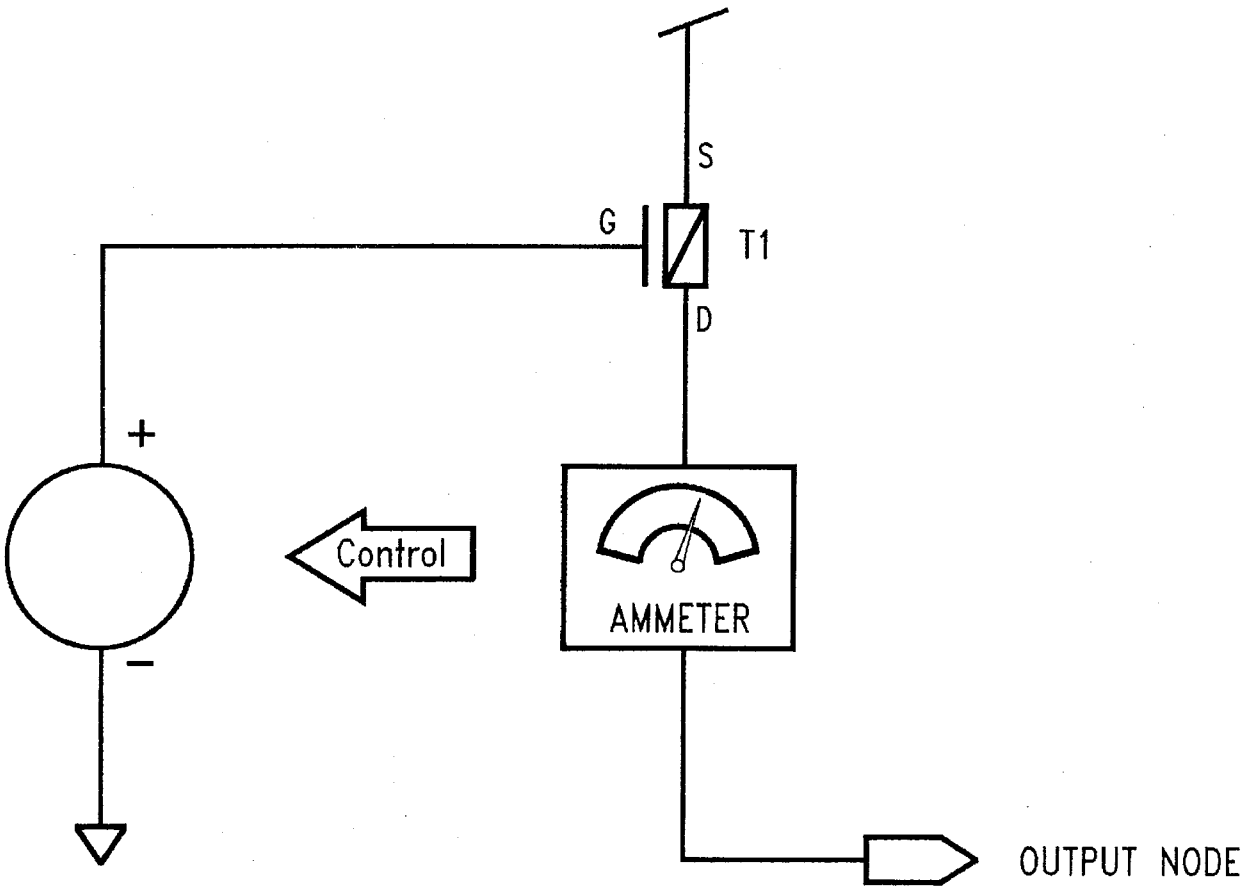
FIG. 2 is diagram of a prior art setup for measuring current in series with an FET output and for compensating the FET device such that it generates a constant current output.
Figure 3:
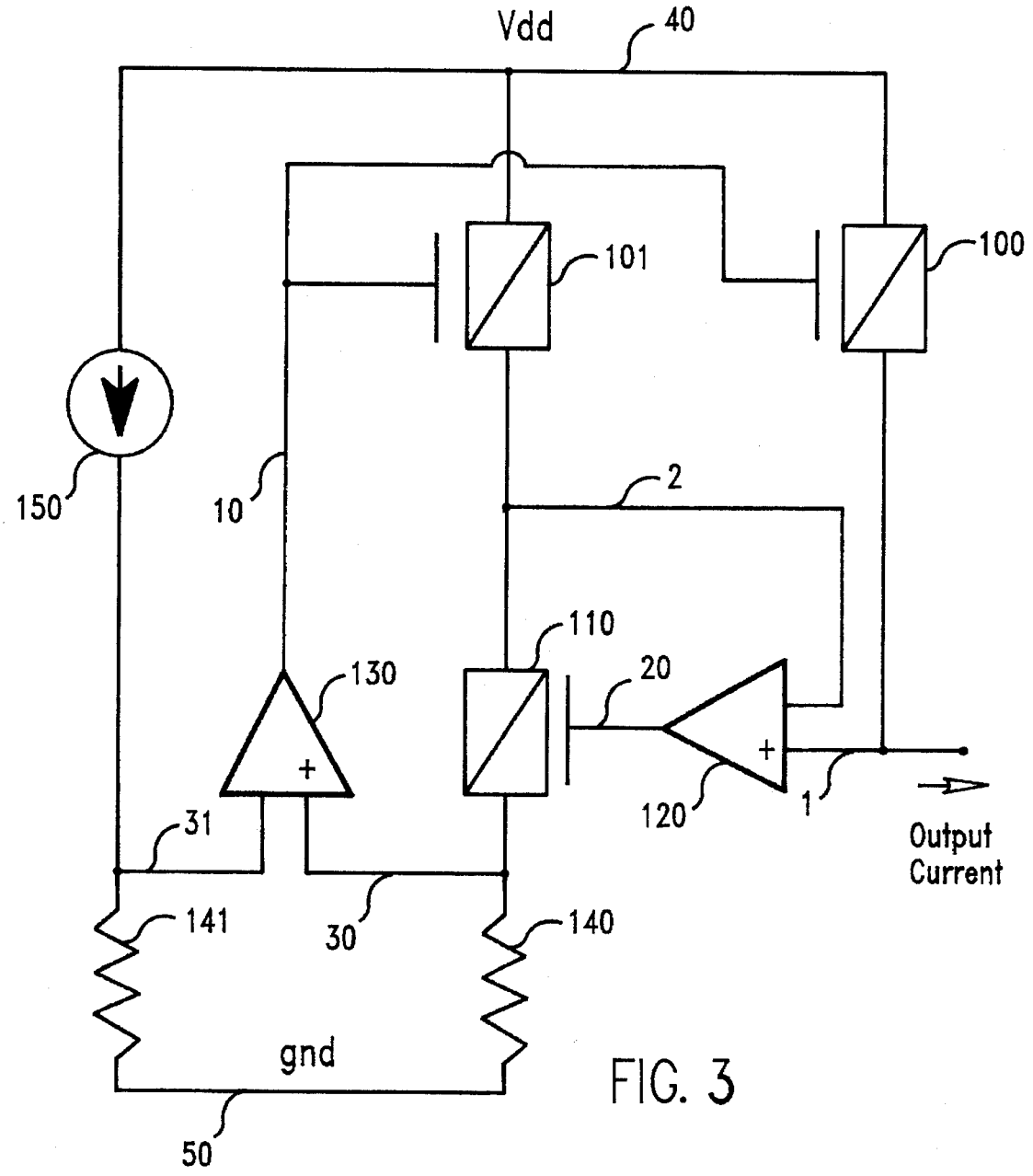
FIG. 3 is a schematic diagram of an active, low Vsd, FET current source, in accordance with the present invention.

Referring now to FIG. 3, an active, low Vsd FET current source in accordance with a preferred embodiment of the present invention is shown.

The current source generates a constant output current at the output node 1. In its preferred embodiment, a first active pass FET 100 is specified to operate at less than 100 mv's between power supply Vdd 40 and the output node 1. Typically, current sources operate most efficiently when the FET operates in its saturation region, wherein the saturation current essentially remains constant over wide variations in the difference of potential between Vdd and the output 1. However, when the voltage between the output node 1 and Vdd becomes too small, the FET device enters its linear region, wherein the FET acts like a variable resistor. Clearly, in the linear region, the FET current source which acts like a variable resistor cannot provide good current regulation and neither can it meet the stringent current regulation specification intended for a circuit of this nature.

In one of the main aspects of the present invention, it is not required that the FET operate in its saturation region. In fact, the present invention allows the FET device to operate, interchangeably, both in the saturation as in the linear regions.

The operation of the circuit will now be described in detail. An FET device, preferably, a pFET, has its source connected to power supply Vdd 40, its gate attached to node 10, the output of a differential amplifier 130, and its drain providing the output port 1 of the current source. As the output voltage varies, the gate voltage 10 is constantly updated to maintain the output current constant. A differential amplifier 130 is used to compare the reference current 150 to the current flowing out of the pFET 100. Since, normally differential amplifiers operate with voltage inputs, it becomes necessary to convert currents into voltages. This is accomplished by resistors 140 and 141, respectively attached to ground. The inputs to the differential amplifier 130 are high impedance, thus, any current provided by the reference current source 150 is assumed to develop the required reference voltage across resistor 141. In the preferred embodiment, resistors 140 and 141 are identical. Similarly, the control voltage at node 30 is generated by the current to voltage conversion across resistor 141. The current being compared is the current that flows through pFET 110. No current flows into the + input of differential amplifier 130.

Ideally, it would be advantageous to use such a feedback scheme to dynamically control the gate voltage 10 such that the output current remains constant. It is, however, an essential aspect of the present invention that the output current through 100 be measured without introducing any elements in series with the pFET 100 that may cause a voltage drop across the element. Instead, a second pass device, pFET 101, is introduced to mirror the current flowing through the output of pFET 100. A perfect mirror is achieved when two criteria are met: 1) when the physical properties of the devices, i.e., size, shape, orientation, process and temperature, and 2) when the electrical environment of the device are identical. By design, the size, shape and orientation of pFET can be made to match those of pFET 100. Furthermore, by placing the two devices in close proximity of each other, both devices are ensured to receive a similar process as well as tight thermal coupling. Clearly, normal process tolerances must be taken into account. In terms of the electrical environment, the source and the gate of pFET 101 are connected in the exact manner as pFET 100, namely, its source as attached to node 40 and its gate to node 10. This leaves only the drain voltages 1 and 2 of pFET 100 and pFET 101, respectively, to be equal.

An undesired aspect of mirroring pFET 100 with an exact replica is that the resulting power dissipation as well as the area used by pFETs 100 and 101 are effectively doubled. By using ratios of currents instead of identical currents in the measurements is not only feasible but also desirable. In the preferred embodiment, a ratio of 20:1 was effectively used, resulting in significant savings in power dissipation and circuit area. This ratio of currents was achieved by placing 20 pFETs, identical to pFET 101, in parallel to create pFET 100. Practitioners of the art will fully appreciate that device parameter tracking and proximity must be carefully maintained in the layout of the current mirror structure to ensure best results.

A combination of differential amplifier 120 and pFET 110 is used to force drain voltages 2 of pFET 101 to be identical to output voltage 1. When drain voltages 1 and 2 are equal, the electrical and physical properties will then also be identical; consequently, the current flowing through pFET 100 will be an exact replica or mirror of pFET 101. Drain voltage 2 of pFET 101 is controlled by putting the differential amplifier 120 in a unity gain mode and in a negative feedback configuration. Differential amplifier 120 forces the difference between output nodes i and 2 to approach zero. The pFET 110 is used as a variable resistor, with its gate attached to the output node 20 of differential amplifier 120. It is important that in the process of setting the drain voltage 2 that no current be sinked or sourced into that node 2, since there is a need to use the current flowing out of pFET 101 in creating the node 30 comparison voltage. This configuration of pFET 110 works exactly as intended, namely, the differential amplifier 120 can control the voltage 2 and yet all the current flowing through pFET 101 is passed directly to the resistor 140.

Thus, the circuit effectively measures the output current through pFET 100 and dynamically compensates for potential current variations arising from output voltage 1 changes. Essentially, differential amplifier 130 indirectly measures the output current and adjusts the gate voltage 10 of the output pFET 100 until the currents match the reference voltage 150.

A byproduct of the aforementioned configuration is that by dynamically controlling the output current, secondary current variation effects are essentially eliminated. By way of example, in all current sources, regardless of their nature, i.e., FET or bipolar, there always exists a finite slope in the I–V characteristics of a transistor current source in the saturation region of the FET device and the linear region of the bipolar device. The slope is oftentimes considered as the output resistance of the current source. More particularly, in FET current sources, the slope of the I–V curve is referred to as "channel length modulation", whereas in bipolar devices, the slope is referred to as the "early voltage effect". In the preferred embodiment, variations in output current due to the slope are removed, since any inherent variations are measured and fully compensated for. This leads to an improvement in current regulation in the order of two orders of magnitude, thereby making this circuit an ultra precise current source.

Best results in system stability, slew rate and gain-bandwidth product of the differential amplifier 120 are achieved when these parameters are approximately 10 times those of 130. This prevents the two amplifiers from interacting in taking control of their respective loops.

Although the present invention has been illustrated and described herein as embodying an integrated current source, it is understood that various modifications and structural changes may be made therein without departing from the spirit of the invention and within the scope and range of equivalents of the claims recited herein after.

What is claimed is:

1. An integrated current source comprising:

first active pass means for generating an output current;

means for measuring said output current;

second active pass means integral to and responsive to said measuring means, whereby said second active pass means mirrors said output current; and controlling means for keeping said output current constant in response to said measuring means, whereby said output current is held constant in the linear region and in the saturation region of said first active pass means.

2. The integrated current source as in claim 1, wherein said first and second active pass means are FET devices.

3. The integrated current source as in claim 1, wherein said first and second active pass devices are bipolar devices.

4. The integrated current source as in claim 1, wherein said measuring and said controlling means are differential amplifiers.

5. The integrated current source as in claim 1, further comprising a reference current source coupled to said controlling means.

6. An integrated current source delivering constant current and operating in a linear region of a transistor device, comprising:

a first and a second pass devices coupled to a first fixed potential node, having each an output respectively driving a first differential amplifier and an input, said first differential amplifier having an output coupled to the output of said second pass device;

a second differential amplifier having a first input coupled to a fixed reference current source, a second input coupled to the output of said second pass device and to a second fixed potential node, and an output connected to the input of each said first and second pass devices, wherein said first pass device outputs a current that remains constant.

7. The current source as recited in claim 6, wherein said second differential amplifier compares a current outputted by said second pass device to a current provided by said fixed reference current source and provides a signal for dynamatically controlling said first and second pass devices such that current outputted by said devices remains constant.

8. The current source as recited in claim 6, further comprising a buffer having a first input connected to the output of said first differential amplifier, a second input coupled to said fixed potential node, said buffer driving said second pass device and said first differential amplifier.

9. The current source as recited in claim 8, wherein the second input of said buffer is coupled to said fixed potential node through a resistor.

10. The current source as recited in claim 6, wherein said reference current source is connected to said fixed potential node through a resistor.

11. The current source as recited in claim 6, wherein said differential amplifier is a high gain amplifier.

12. The current source as recited in claim 6, wherein said first and second pass devices are FET devices.

13. The current source as recited in claim 6, wherein said first and second pass devices are bipolar devices.

14. The current source as recited in claim 6, wherein the output of said first pass device is connected to a load.

15. The current source as recited in claim 6, wherein said reference current source provides a reference for which a constant current is generated at the output of said first pass device.

16. An integrated, low Vsd, current source operating in the active region of a transistor device, and delivering a constant current, comprising:

a first and a second pass devices having each, a first input coupled to a first fixed potential node, and an output respectively connected to an input of a first differential amplifier;

a buffer having a first input connected to the output of said first differential amplifier, a second input coupled to a second fixed potential node, said buffer driving said first differential amplifier;

a second differential amplifier having a first input coupled to a fixed reference current source, a second input coupled to said second fixed potential node, and an output connected to a second input of each said first and second pass devices, wherein said first pass device outputs a current that remains constant.

17. The current source as recited in claim 16, wherein said second differential amplifier compares a current outputted by said second pass device to a current provided by said fixed reference current source and provides a signal for dynamatically controlling said first and second pass devices such that current outputted by said devices remains constant.

18. The current source as recited in claim 16, wherein said fixed reference current source is coupled to said first and second fixed potential node.

19. The current source as recited in claim 16, wherein the second input of said buffer is coupled to said fixed potential node through a resistor.

20. The current source as recited in claim 16, wherein said fixed reference current source is connected to said second fixed potential node through a resistor.

* * * * *